US005495982A

United States Patent [19]

Wang

[11] Patent Number: 5,495,982

[45] Date of Patent: Mar. 5, 1996

[54] PAPER CUP WITH A STRAW

[76] Inventor: Mein-Aing Wang, No. 42, Alley 121, Lane 56, Go–An, St. Tainan, Taiwan

[21] Appl. No.: 492,582

[22] Filed: Jun. 20, 1995

[51] Int. Cl.[6] ..... B65D 5/74

[52] U.S. Cl. ..... 229/103.1; 229/193; 229/404

[58] Field of Search ..... 229/103.1, 193, 229/400, 404, 405; 220/705, 710; 383/36

[56] References Cited

U.S. PATENT DOCUMENTS

| | | | |
|---|---|---|---|
| 1,219,152 | 3/1917 | Reid | 229/404 |
| 1,255,133 | 2/1918 | Carr | 229/405 |
| 2,220,746 | 11/1940 | Wentz | 229/103.1 |
| 2,599,919 | 6/1952 | Hucknall | 220/710 |
| 2,838,220 | 6/1958 | Oppenheimer et al. | 229/103.1 |
| 3,279,679 | 10/1966 | Engelsher et al. | 229/130.1 |
| 3,367,380 | 2/1968 | Dickey | 383/36 |
| 3,726,469 | 4/1973 | Koehler | 229/193 |
| 3,774,804 | 11/1973 | Henning | 229/103.1 |
| 3,921,889 | 11/1975 | Gibbons | 229/103.1 |
| 5,423,476 | 6/1995 | Ferrer | 229/103.1 |

FOREIGN PATENT DOCUMENTS

| | | | |
|---|---|---|---|
| 978901 | 1/1965 | United Kingdom | 229/103.1 |
| 8604314 | 7/1986 | WIPO | 220/710 |

*Primary Examiner*—Gary E. Elkins

[57] ABSTRACT

A paper cup with a straw formed from a sheet of paper by folding and adhering, to have a cup body portion, a bottom portion and a cap portion. A straw is formed by two adhered side portions, each provided with a vertical semicircular groove. The straw has its lower end communicating with the interior of the cup body and an upper end serving as an outlet.

1 Claim, 3 Drawing Sheets

PAPER CUP WITH A STRAW

BACKGROUND OF THE INVENTION

This invention relates to a paper cup with a straw, particularly such formed from a sheet of paper and provided with a straw also formed with the same paper at one side portion of the cup body portion for drinking what is contained in the cup sealed with a cap.

As development of the civilization has been progressing, the environmental and hygienic problem has been regarded as being very important. People are more and more inclined to engage in leisure activities when they have time, and things such as foods or utensils to be carried out for a picnic, excursion, camping or trip have to be taken care of in regard of hygienic considerations. Besides, contagious diseases such as B-type hepatitis have been prevalent, so culinary hygiene cannot be ignored, and therefore, discardable food dishes or containers have become popular. However, since some materials, such as plastic, are not biodegradable, pollution of the environment occurs, causing great problems.

SUMMARY OF THE INVENTION

This invention has been devised to offer a paper cup with a straw, which is biodegradable after being discarded, so as not to cause a problem to the environment, which is very important to our lives.

A main feature of this invention is the material of the cup, a sheet of paper, which is formed into a paper cup with an integral straw also formed from paper by folding and adhering two symmetrical portions of the cup body.

DETAILED DESCRIPTION OF THE INVENTION

Figure 1:
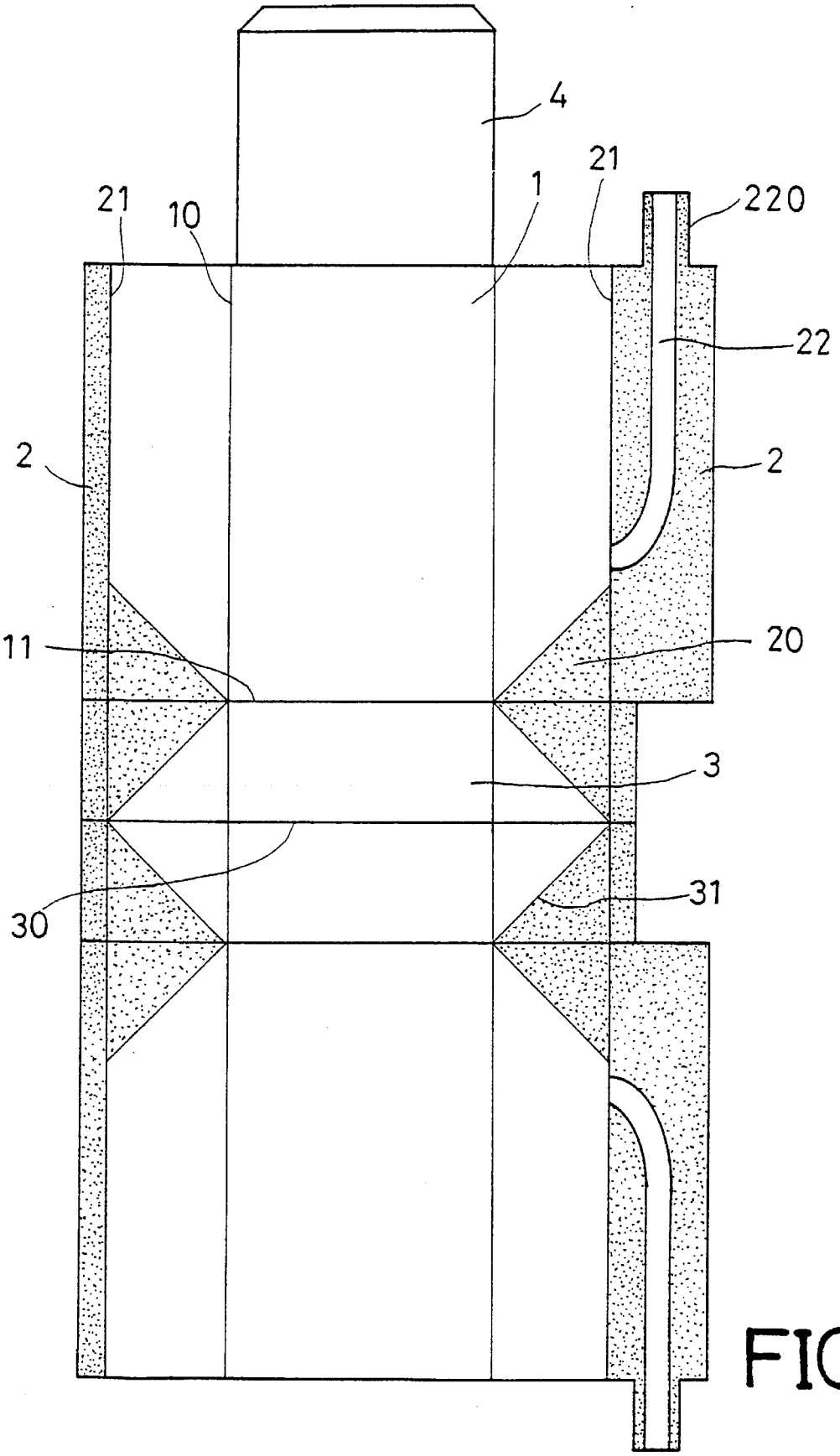
FIG. 1 is a plan view of a paper cup with a straw of the present invention, showing a sheet of paper for the paper cup in a spread condition before being folded.
Figure 2:
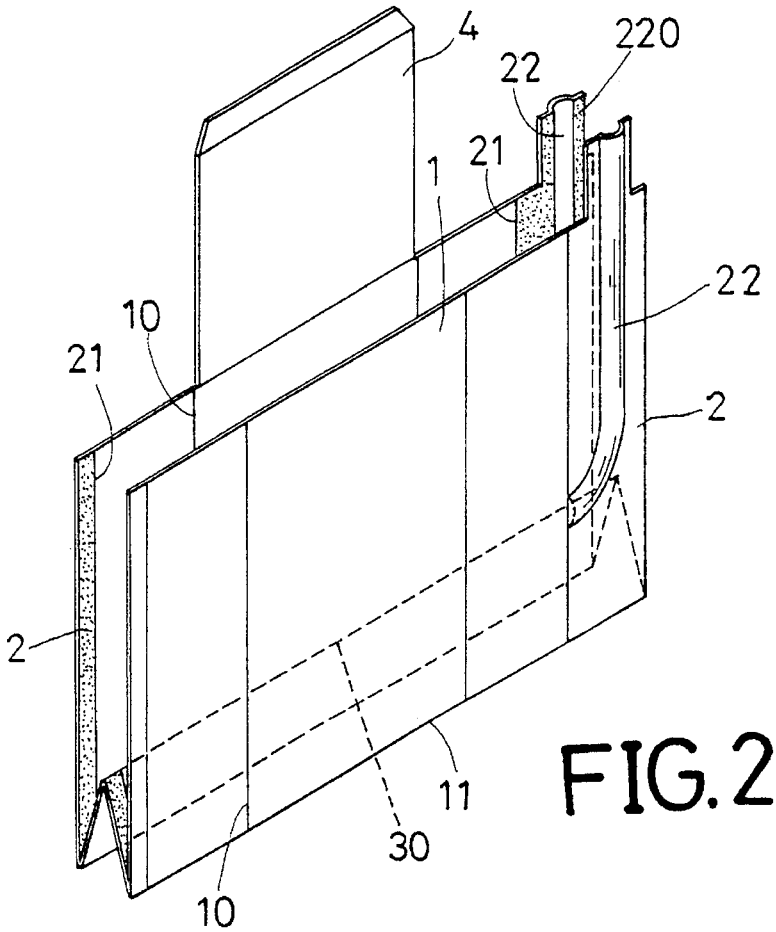
FIG. 2 is a perspective view of the paper cup with a straw in the present invention, showing it in a first stage of folded-up condition.

A paper cup with a straw in the present invention, is formed from a sheet of paper as shown in FIG. 2, and the paper comprises a cup body portion 1, two vertical side adhering portion s 2, 2, a bottom portion 3 and a cap portion 4 in continuous condition.

The cup body portion 1 has two lengthwise parallel folding lines 10, 10, two lateral parallel bottom folding lines 11, 11 to define the bottom portion 3 between them, two pairs of two continuous triangular portions 20 respectively half in two opposite sides of the bottom portion 3 and half in the cup body portion, a lengthwise folding line 21 respectively on two opposite lengthwise sides of both the cup body 1 and the bottom portion 3 to define each side adhering vertical portion 2. One of the vertical adhering portions 2 has a larger width than the other same portion 2, an elongate groove 22 respectively in an upper half and in a lower half of the larger adhering portion 2 and a projecting section 220 abutting the groove 22.

A center folding lateral line 30 is provided in the bottom portion 3, and a M-shaped folding line 31 respectively is formed along the profile of each of the two continuous triangular portions 20. So it is apparent that two symmetrical portions are formed at both sides of the center folding lateral line 30, except the cap portion 4 additionally provided with one of the two symmetrical portions, extending upward from the cup body portion 1.

The cap portion 4 is provided on top of the cup body portion 1 and is shaped as square or rectangular, having two opposite side edges in an aligned position with the two lengthwise folding lines 10, 10.

Figure 4:
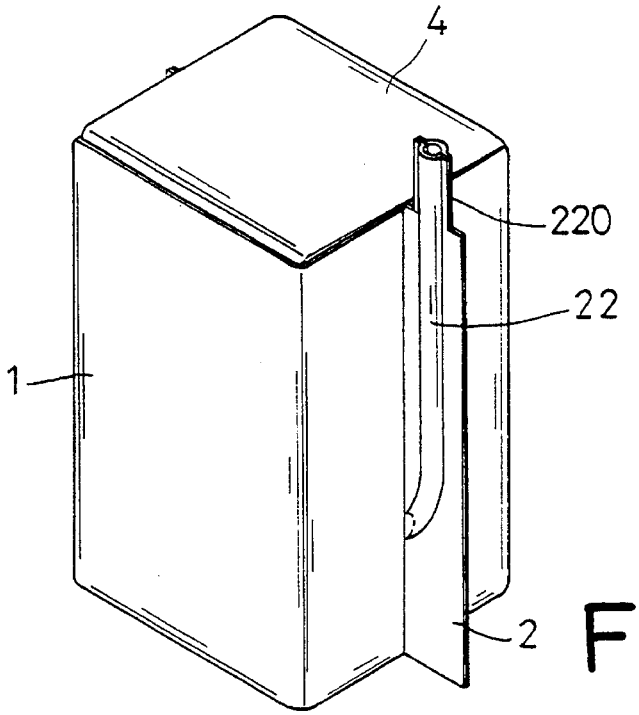
FIG. 4 is a perspective view of the paper cup with a straw of the present invention.
Figure 3:
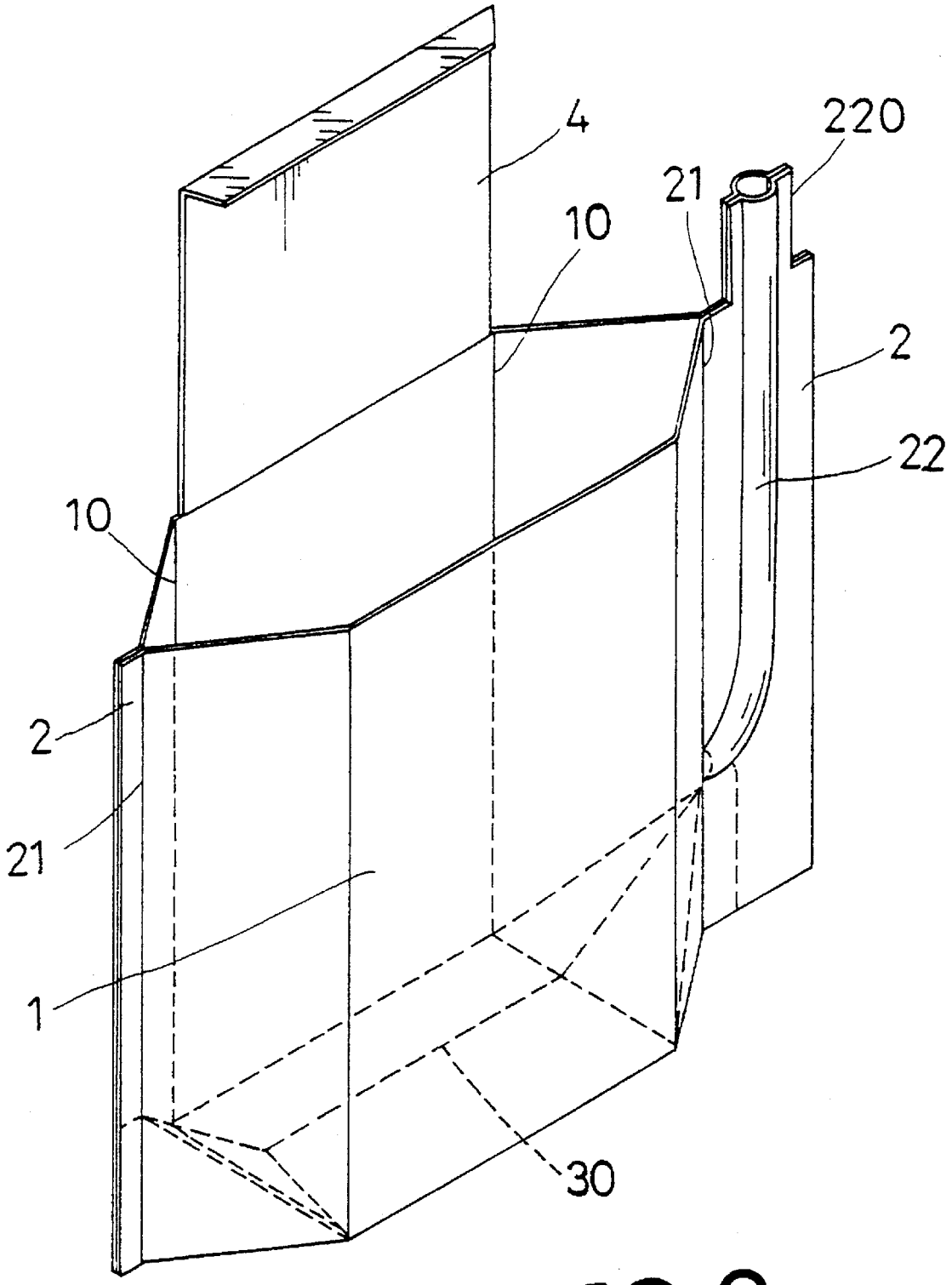
FIG. 3 is a perspective view of the paper cup with a straw in the present invention, showing it being folded from the spread condition to the folded condition in FIG. 2 to a final shape.

In folding the piece of paper just described to form a paper cup with a straw, referring to FIGS. 2, 3 and 4, firstly folding the two lateral folding lines 11, 11 and the folding line 30 as shown in FIG. 2 so that each of two symmetrical portions is made to stand upright, adhering two folded sections of each adhering portion 2 with each other and two sections of each continuous triangular portion 20 with each other at two opposite sides of the cup body portion 1. Next, the cup body portion 1 is spread out, with the lateral folding line 30 being pressed down to form the bottom portion 3 in a right angle to the cup body portion 1. After that, each of the two portions including the adhered portions 2 and each side portion of the cup body portion 1 extending laterally out from each vertical lengthwise line 10 is forcibly pressed inward to the shape shown in FIG. 3, in order to strengthen the cup body portion 1. The two sections of the larger adhering portion 2 respectively having the groove 22 and the projecting up section 220 are adhered together so that a straw is formed by the two grooves 22, 22 thereof and can be sucked at an upper projection 220 to drink what is contained in this paper cup. Lastly, the cap portion 4 is folded and sealed on an upper opening of the cup body portion 1, preventing what is contained in the cup body portion 1 from flowing out.

It is easily appreciated from the description that this paper cup with a sucking tube has advantages as follows.

1. It is formed with a sheet of paper with pressed folding lines, convenient for use.

2. It is quick to process, extremely economical in manufacture.

3. It is very light and very thin, taking a small space, easy for carrying and conforming to hygienic safety.

What is claimed is:

1. A paper cup with an integral straw formed of a sheet of paper by folding and adhering, comprising:

a cup body portion, having two lengthwise parallel folding lines and two lateral parallel folding lines defining a bottom portion between said two lateral lines;

lengthwise adhered portions respectively at each of two opposite sides of said cup body portion, a W-shaped adhered portion respectively at two opposite sides of the bottom portion, and a pair of said lengthwise adhered portions having a semicircular groove with an upper projection extending upward from an upper edge of said cup body portion;

the bottom portion limited between the two lateral folding lines having a center, a lateral folding line in the center, and a W-shaped folding line respectively at two opposite sides of the bottom portion; and, a cap portion extending upward from the upper lateral edge of said cup body portion; whereby, said lengthwise adhered portions having the semicircular grooves with an upper projection form a straw, said straw having an upper end serving as an outlet and a lower end communicating with an interior of said cup body, said cap portion folded down to close and seal an upper opening of the cup body.

* * * * *